US005782022A

United States Patent [19]

Tubberville

[11] Patent Number: 5,782,022

[45] Date of Patent: Jul. 21, 1998

[54] METHOD AND APPARATUS FOR MOUNTING MILITARY MEDALS ON A UNIFORM

[76] Inventor: William J. Tubberville, 12736 Foxhound Dr., Maryland Heights, Mo. 63043

[21] Appl. No.: 821,613

[22] Filed: Mar. 20, 1997

[51] Int. Cl.[6] ..... A44C 3/00

[52] U.S. Cl. ..... 40/1.6; 40/1.5

[58] Field of Search ..... 40/1.5, 1.6

[56] References Cited

U.S. PATENT DOCUMENTS

| | | | |
|---|---|---|---|
| 2,402,561 | 6/1946 | Levingston | 40/126 |
| 2,464,395 | 3/1949 | Hiborn | 40/1.5 |
| 3,552,052 | 1/1971 | Allen | 40/156 |
| 4,063,639 | 12/1977 | Grant | 206/0.82 |
| 4,244,303 | 1/1981 | Kurasik | 109/23 |
| 4,385,688 | 5/1983 | Grant | 206/0.83 |
| 4,425,997 | 1/1984 | Grant | 206/0.84 |
| 4,687,103 | 8/1987 | Corlett | 206/566 |
| 4,821,883 | 4/1989 | Miller | 206/495 |
| 4,905,821 | 3/1990 | Corlett | 206/45.24 |
| 5,118,171 | 6/1992 | Ortiz | 312/114 |

*Primary Examiner*—Cassandra H. Davis
*Attorney, Agent, or Firm*—Tobor & Goldstein, L.L.P.

[57] ABSTRACT

A method and apparatus for mounting a plurality of military medals on a uniform includes a ribbon bar member which is received within a ribbon bar clamp member, whereby the ribbons are clamped between the ribbon bar member and the ribbon bar clamp member.

18 Claims, 4 Drawing Sheets

METHOD AND APPARATUS FOR MOUNTING MILITARY MEDALS ON A UNIFORM

BACKGROUND OF THE INVENTION

1. Field of the Invention

The invention relates to a method and apparatus for substantially, simultaneously, mounting a plurality of military medals on a uniform.

2. Description of the Prior Art

When military personnel, who have been awarded a plurality of military medals in honor of various achievements, desire to wear their medals on military uniforms, such as dress military uniforms, it is important that the medals be worn in accordance with very stringent military regulations governing the placement and mounting of the medals upon the military uniform. Typically, each medal is suspended from a ribbon, and the ribbons must be properly spaced from adjacent ribbons. For example, in the United States Marine Corps, four medals can be mounted on the uniform in a side-by-side relationship, without any portions of the adjacent ribbons overlapping adjacent ribbons. Some military regulations, such as those of the United States Marine Corps, permit the mounting up to seven medals in a row, with portions of the ribbons of adjacent medals, not exceeding fifty percent, overlapping the ribbon portions of adjacent medals.

Once the individual has at least two medals for mounting upon his uniform, the two medals are typically sent to a company, or medal mounting service, which specializes in mounting the at least two medals to a device which permits the two medals to be mounted to the uniform as a unit. The individual who received the medals is responsible for the costs associated with these medal mounting services, the cost of which can be significant, particularly for military personnel. Additionally, the individual cannot properly mount his medals himself, but must rely upon the medal mounting service, including expending the time necessary to send the medals to the medal mounting service. Additionally, the individual cannot immediately wear his medals until he has received them from the medal mounting service. Another disadvantage with these medal mounting services, is that once two medals have been mounted and the individual receives additional medals, the individual must begin the process anew. He must obtain new ribbons, since the previously four mounted ribbons cannot again be used or remounted, but are permanently secured to the medal mounting device used by the medal mounting service. Thus, the individual must again expend the time and money necessary to have his medals properly spaced and secured upon a permanent device, before he can wear his medals in accordance with military regulations.

Accordingly, prior to development of the present invention, there has been no method and apparatus for mounting a plurality of military medals on a uniform which: is efficient and economical to use; permits military personnel to wear and display their medals without the use of medal mounting services; and permits the plurality of medals to be adjusted and remounted, upon the individual receiving additional medals. Therefore, the art has sought an apparatus and method for mounting a plurality of military medals on a uniform which: is efficient and economical to use; permits military personnel to properly mount a plurality of military medals on their uniform, without the use of an outside medal mounting service; and permits the same medals to be adjusted and reused on their uniform, upon additional medals being awarded and received.

SUMMARY OF THE INVENTION

In accordance with the invention, the foregoing advantages have been achieved through the present apparatus for mounting a plurality of military medals on a uniform, each medal being suspended from a ribbon. The present invention includes an elongate ribbon bar member having a front and a rear surface, and an upper edge and a lower edge; an elongate ribbon bar clamp member which receives the ribbon bar member and is adapted to clamp a portion of each ribbon between the ribbon bar member and the ribbon bar clamp member; and means for attaching the ribbon bar member and the ribbon bar clamp member to the uniform, whereby the plurality of military medals may be substantially, simultaneously mounted to the uniform. A feature of the present invention is that the ribbon bar clamp member may include an elongate front wall having a forward facing surface and a rearward facing surface, upper and lower ends, and an upper flange member associated with the upper end of the front wall, and a lower flange member associated with the lower end of the front wall; the front wall and upper and lower flange members defining a cavity which receives the ribbon bar member, and the cavity being adapted to also receive a portion of each ribbon.

A further feature of the present invention is that the ribbon bar clamp member may include a means for securing the ribbon bar member within the cavity, and the securing means may include at least one protrusion disposed on the ribbon bar clamp member, which engages with at least one recess in the ribbon bar member to secure the ribbon bar member within the cavity. Another feature of the present invention is that the securing means may include a lip member which extends downwardly from the upper flange member. Another feature of the present invention is that the ribbon bar member may include a means for securing at least a portion of each ribbon to the front surface of the ribbon bar member, and the front wall of the ribbon bar clamp member may include a means for securing at least a portion of each ribbon to the forward facing surface of the front wall after the ribbon bar member has been received within the cavity.

Additional features of the present invention may include the ribbon bar member and the ribbon bar clamp member each having a longitudinal axis, with the longitudinal axes of the ribbon bar member and the ribbon bar clamp member being disposed substantially parallel with respect to each other, and the ribbon bar clamp member may include a means for preventing relative movement of the ribbon bar member with respect to the ribbon bar clamp member, in a direction along the longitudinal axes of the ribbon bar member and the ribbon bar clamp member. The means for preventing relative movement may include at least one recessed slot which receives at least one outwardly extending foot member associated with the ribbon bar member. A further feature of the present invention is that the upper edge of the ribbon bar member may be provided with a smooth, rounded surface. Another feature of the present invention is that ribbon spacing indicia means may be disposed on the front surface of the ribbon bar member.

In accordance with the invention, the foregoing advantages have also been achieved through the present method for substantially, simultaneously mounting a plurality of military medals on a uniform, each medal being suspended from a ribbon. This aspect of the present invention includes the steps of: providing an elongate ribbon bar member having a front and a rear surface and an upper edge and a lower edge; providing an elongate ribbon bar clamp member; disposing and clamping a portion of each ribbon between the ribbon bar member and the ribbon bar clamp member; and attaching the ribbon bar member and the ribbon bar clamp member to the uniform, with a portion of each of the ribbons disposed and clamped between the ribbon bar member and the ribbon bar clamp member.

Another feature of this aspect of the present invention may include the steps of: providing the ribbon bar clamp member with an elongate front wall having upper and lower ends, an upper flange member associated with the upper end of the front wall, and a lower flange member associated with the lower end of the front wall to define the cavity; receiving the ribbon bar member within the cavity; and receiving a portion of each ribbon within the cavity. An additional feature of this aspect of the present invention may include the step of securing the ribbon bar member within the cavity, by snap fitting the ribbon bar member within the cavity. A further feature of the present invention may include the step of securing at least a portion of each ribbon to the front surface of the ribbon bar member. The ribbon bar clamp member may be provided with a front wall with a forward facing surface; and providing a means for securing at least a portion of each ribbon to the forward facing surface of the front wall after the ribbon bar member has been received within the cavity.

Another feature of this aspect of the present invention may include the step of preventing relative movement of the ribbon bar member with respect to the ribbon bar clamp member in a direction along the longitudinal axes of the ribbon bar member and the ribbon bar clamp member. Another step of this aspect of the present invention may be providing the upper edge of the ribbon bar member with a smooth, rounded surface, and the front surface of the ribbon bar member may be provided with a ribbon spacing indicia means, which is utilized to evenly space a portion of each ribbon from, and with respect to, portions of adjacent ribbons.

The present method and apparatus for mounting a plurality of military medals on a uniform, when compared with previously proposed prior art methods and apparatus, have the advantages of being: efficient and economical to use; permits military personnel to properly mount the medals without the use of the services of a medal mounting service; and permits previously mounted medals to be adjusted, reused, and remounted.

While the invention will be described in connection with the preferred embodiment, it will be understood that it is not intended to limit the invention of that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
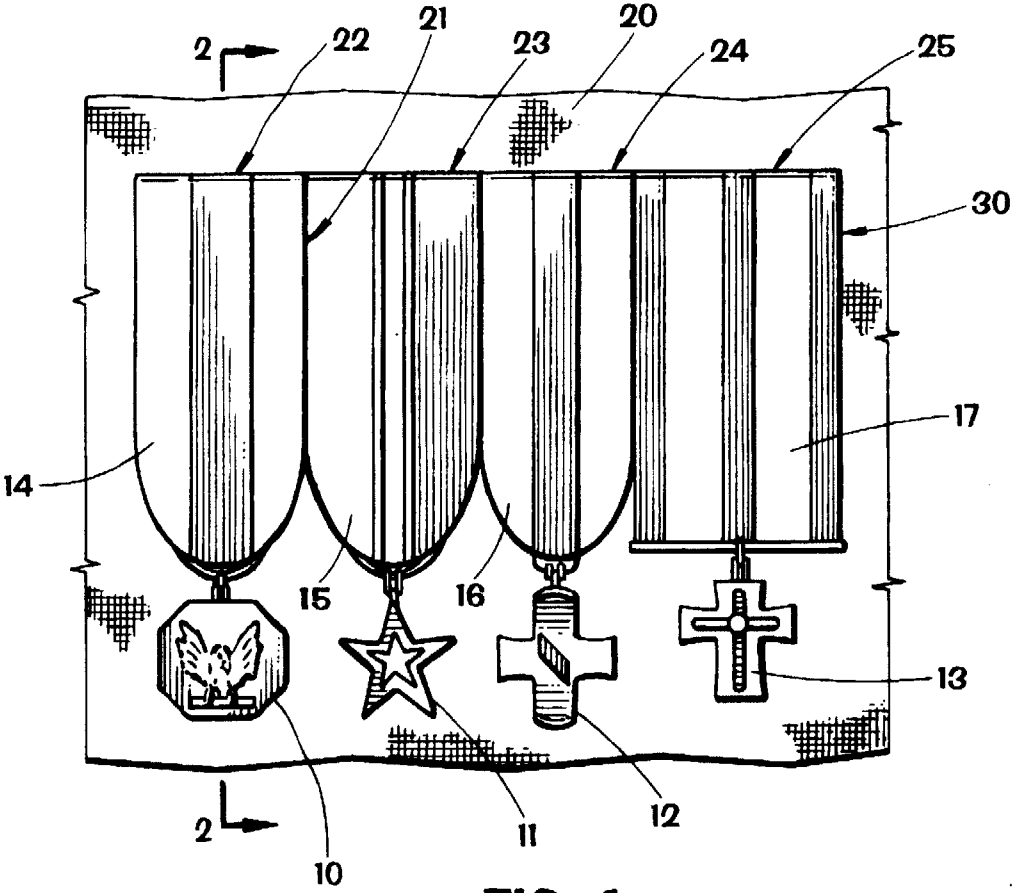
FIG. 1 is a front view of a portion of a military uniform having a plurality of military medals mounted thereon, in accordance with the present invention.

In FIG. 1, four military medals 10–13 are shown each suspended from a ribbon 14–17, and the military medals 10–13 and associated ribbons 14–17 are mounted to a uniform 20. Military regulations, such as those of the United States Marine Corps, permit four military medals to be mounted to uniform 20 with the ribbons of each medal disposed in an abutting relationship with adjacent ribbons, as illustrated at 21 with respect to adjacent ribbons 14 and 15. All that is visible to the viewer of uniform 20 is ribbons 14–17, and their associated medals 10–13. The tops 22–25 of ribbons 14–17 must be disposed coplanar with each other as illustrated in FIG. 1. The apparatus 30 of the present invention for mounting the plurality of military medals 10–13, is not visible in FIG. 1, but is designed so as to be not visible as will be hereinafter described.

Figure 2:
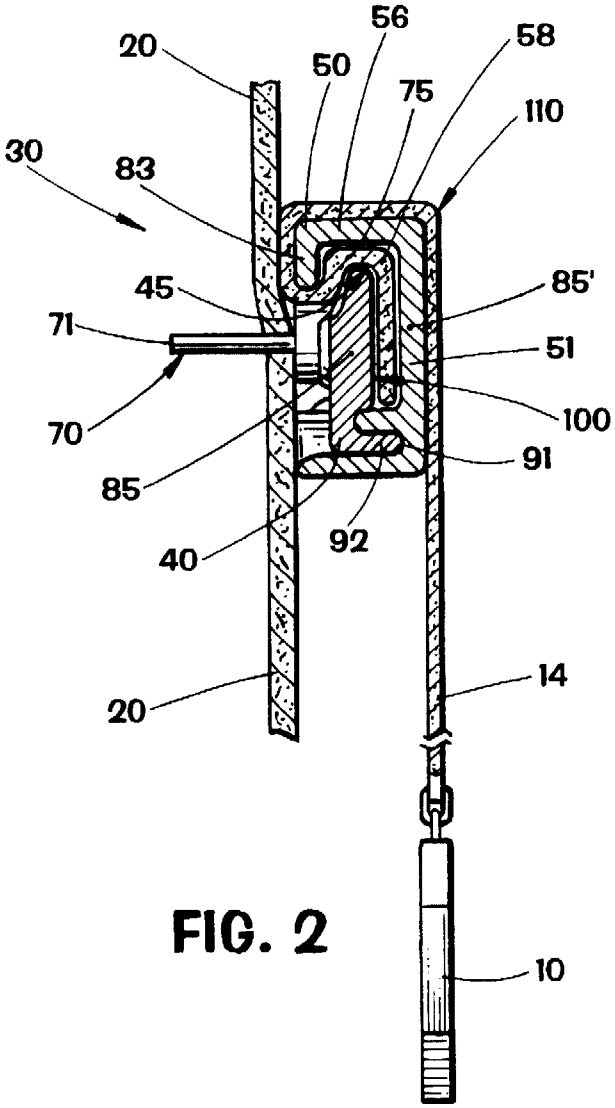
FIG. 2 is a partial cross-sectional configuration taken along lines 2—2 of FIG. 1, and lines 2'—2' of FIG. 3.
Figure 3:
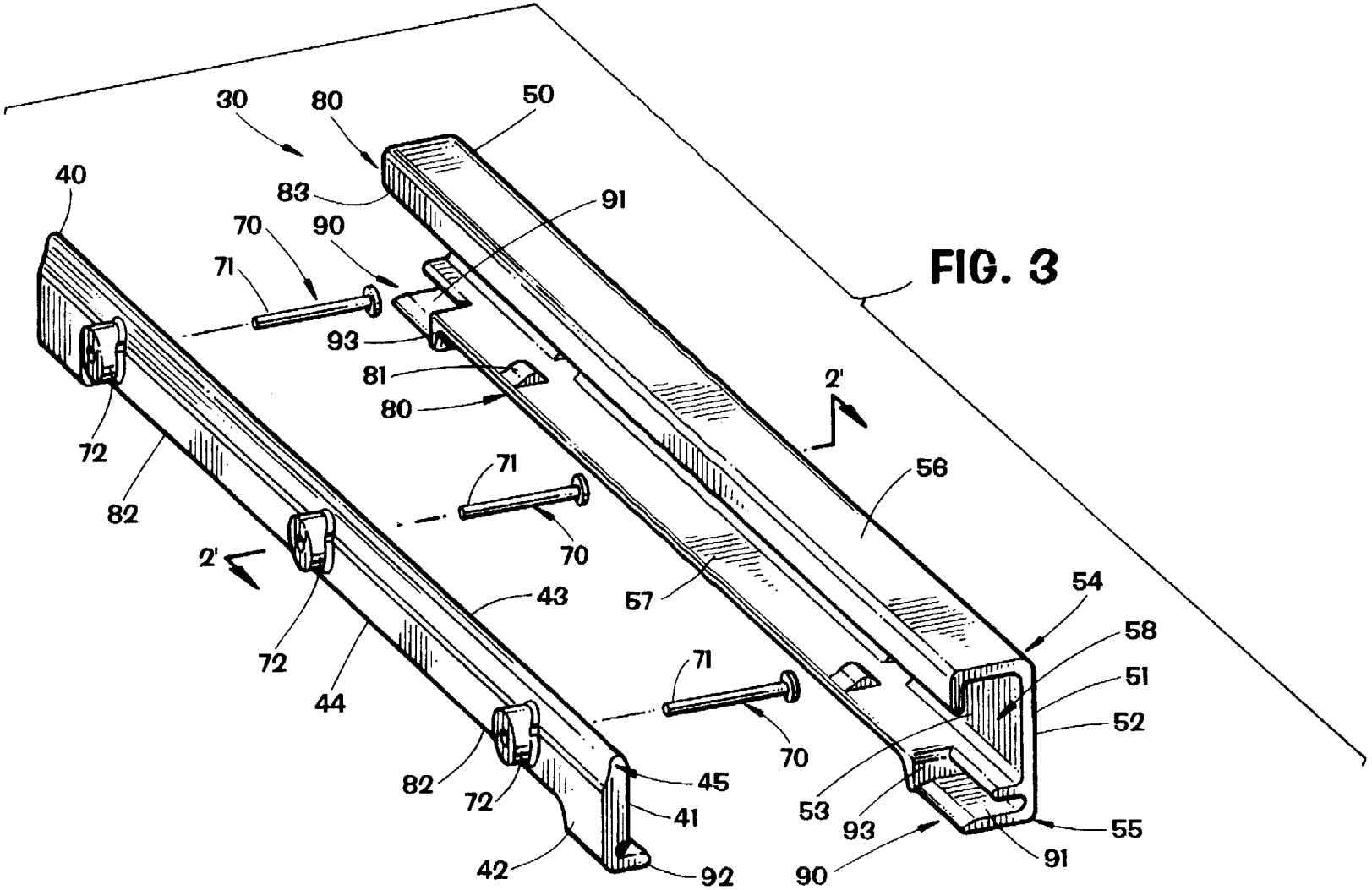
FIG. 3 is a perspective, exploded view of the apparatus of the present invention.

With reference to FIGS. 2–3, the apparatus 30 of the present invention for mounting a plurality of medals 10–13 is shown to generally include: an elongate ribbon bar member 40; an elongate ribbon bar clamp member 50; and a means for attaching 70 the ribbon bar member 40 and the ribbon bar clamp member 50 to uniform 20. Ribbon bar member 40 and ribbon bar clamp member 50 may be formed of any suitable material having the requisite strength characteristics to permit them to function in the manner hereafter described. Preferably, ribbon bar member 40 and ribbon bar clamp member 50 are made of a suitable plastic material, such as polystyrene plastic, although any other plastic material capable of functioning in the manner hereinafter described could be utilized. It will be apparent to one of ordinary skill in the art that other materials, could be used, such as wood or metal. Ribbon bar member 40 has a front surface 41 and a rear surface 42, the rear surface facing rearwardly toward uniform 20. Ribbon bar member 40 also has upper and lower edges 43, 44, and as seen in FIGS. 2 and 3, upper edge 43 is preferably formed with a smooth, rounded surface, as seen at 45. Attaching means 70 for attaching ribbon bar member 40 and ribbon bar clamp member 50 to uniform 20, may be any conventional device which could function to attach apparatus 30 to uniform 20, such as pins, snaps, studs, adhesives, and/or hook and eye fastener material, such as VELCRO®. Preferably, at least one, and preferably three, pins 71 are associated with ribbon bar member 40, such as by inserting pins 71 within bosses 72 which are formed integrally with ribbon bar member 40. As will be hereinafter described in greater detail, upon apparatus 30 being assembled, apparatus 30 is pressed against uniform 20 until pins 71 pass through the uniform 20 as seen in FIG. 2. Conventional pin clamps (not shown) are mounted upon pins 71 to secure apparatus 30 to uniform 20.

Still with reference to FIGS. 2 and 3, it is seen that ribbon bar clamp member 50 receives ribbon bar member 40, and thus clamps a portion 75 of each ribbon 14–17 between the ribbon bar member 40 and the ribbon bar clamp member 50. Ribbon bar clamp member 50 includes an elongate front wall 51 having a forward facing surface 52 and a rearward facing surface 53, and upper and lower ends 54, 55. An upper flange member 56 is associated with the upper end 54 of the front wall 51, and a lower flange member 57 is associated with the lower end 55 of the front wall 51. As seen in FIG. 2, the front wall 51, upper flange member 56, and lower flange 57, define a cavity 58 which receives the ribbon bar member 40 and a portion 75 of each ribbon 14–17. Preferably, upper flange member 56 and lower flange 57 are formed integrally with front wall 51.

Ribbon bar clamp member 50 preferably includes a means for securing 80 the ribbon bar member 40 within cavity 58. Preferably securing means 80 includes at least one protrusion 81 disposed on the ribbon bar clamp member 50, and the at least one protrusion 81 engages with at least one recess 82 in the ribbon bar member 40 to secure the ribbon bar member 40 within cavity 58. Preferably, two protrusions 81 and two matching recesses 82 are provided. As seen in FIG. 3, protrusions 81 are disposed upon the lower flange member 57, and the recesses 82 are disposed along the lower edge 44 of ribbon bar member 40. Upon ribbon bar member 40 being inserted within cavity 58 in the configuration illustrated in FIG. 2, protrusions 81 may be snap fitted into recesses 82 to secure ribbon bar member 40 within cavity 58. Securing means 80 may also include a lip member 83 which extends downwardly from the upper flange member 56 of ribbon bar clamp member 50. Lip member 83 additionally assists in securing ribbon bar member 40 within cavity 58 of ribbon bar clamp member 50.

Still with reference to FIGS. 2 and 3, ribbon bar member 40 and ribbon bar clamp member 50 each have a longitudinal axis 85, 85', and the ribbon bar member 40 and the ribbon bar clamp member 50 are disposed substantially parallel with each other. Preferably, ribbon bar clamp member 50 includes a means for preventing 90 relative movement of the ribbon bar member 40 with respect to the ribbon bar clamp member 50 in a direction along the longitudinal axis 85, 85' of the ribbon bar member 40 and the ribbon bar clamp member 50. Preferably the means for preventing 90 relative movement includes at least one recessed slot 91 associated with the lower flange member 57 of ribbon bar clamp member 50, and the at least one recessed slot 91 receives at least one outwardly extending foot member 92 associated with the ribbon bar member 40. Preferably, two recessed slots 91 are provided at either end of elongate ribbon bar clamp member 50, and there are two outwardly extending foot members 92 disposed along the lower edge 44 at both ends of ribbon bar member 40. As seen in FIG. 2, foot members 92 are snugly received within recessed slots 91 formed in ribbon bar clamp member 50. Each recessed slot 91 may include an upstanding side wall 93, against which its corresponding foot member 92 abuts. The abutting engagement between foot members 92 and side walls 93 further assist in preventing relative movement between the ribbon bar member 40 and the ribbon bar clamp member 50.

Figure 7:
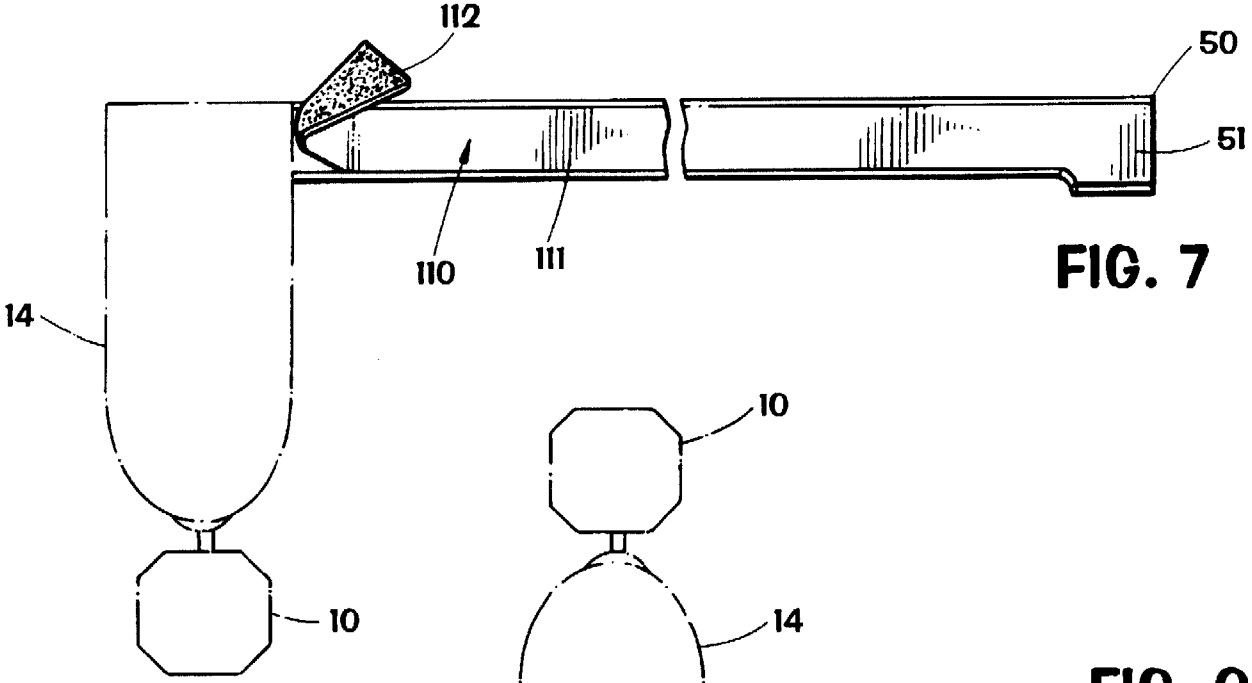
FIG. 7 is a front view of a ribbon bar clamp member of the present invention.
Figure 6:
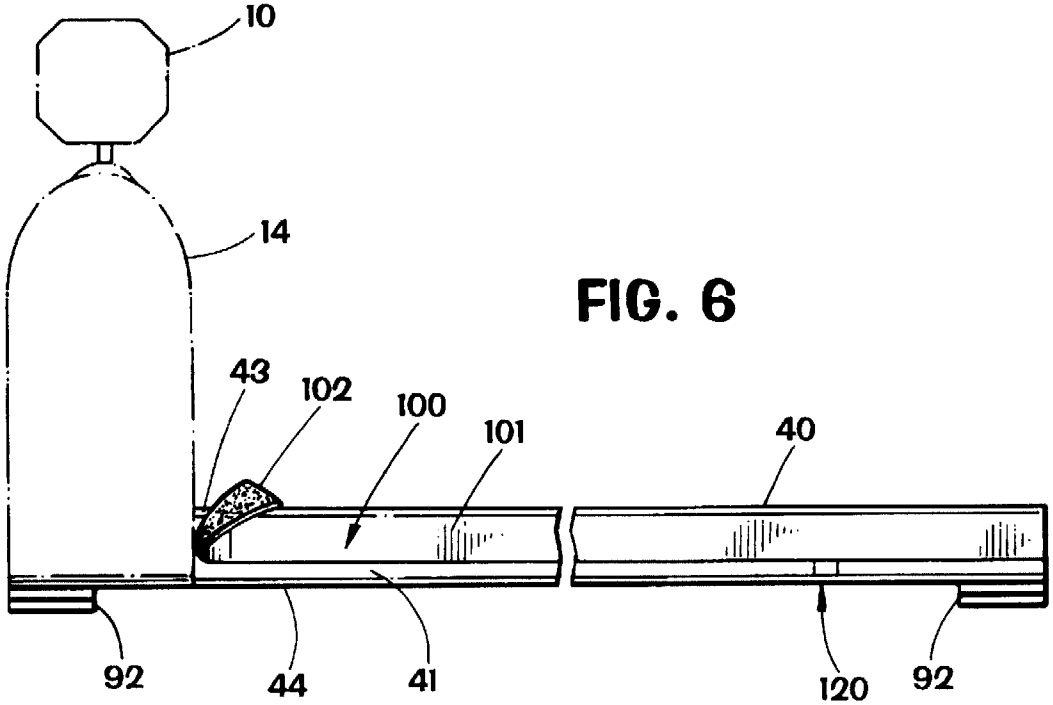
FIG. 6 is a front view of a ribbon bar member in accordance with the present invention.

The ribbon bar member 40 may include a means for securing 100 at least a portion 75 of each ribbon 14–17 to the front surface 41 of the ribbon bar member 40. Ribbon securing means 100 could be: a conventional adhesive; screws; small sharp projections formed on the front surface 41 of ribbon bar member 40; hook and eye material, such as VELCRO®, the hook portion being applied to the front surface 41 of ribbon bar member 40 and the eye portion disposed on the ribbon portion 75; or similar types of securing means. Preferably, as shown in FIGS. 2 and 6, ribbon securing means 100 is a length of double-sided adhesive tape 101 applied along the length of front surface 41 of ribbon bar member 40. The tape 101 could be a transparent double-sided adhesive tape or a double-sided adhesive foam tape. Similarly, the front wall 51 of the ribbon bar clamp member includes a means for securing 110 at least a portion 111 of each ribbon 14–17 to the forward facing surface 52 of the front wall 51 of ribbon bar clamp member 50 after the ribbon bar member 40 has been received within the cavity 58. Again, any suitable device or technique, such as previously described, could be used for ribbon securing means 110; however, it is preferred that ribbon securing means 110 also be a length of double-sided adhesive tape 111 which extends along the length of the forward facing surface 52 of front wall 51, as shown in FIGS. 2 and 7.

Figure 4:
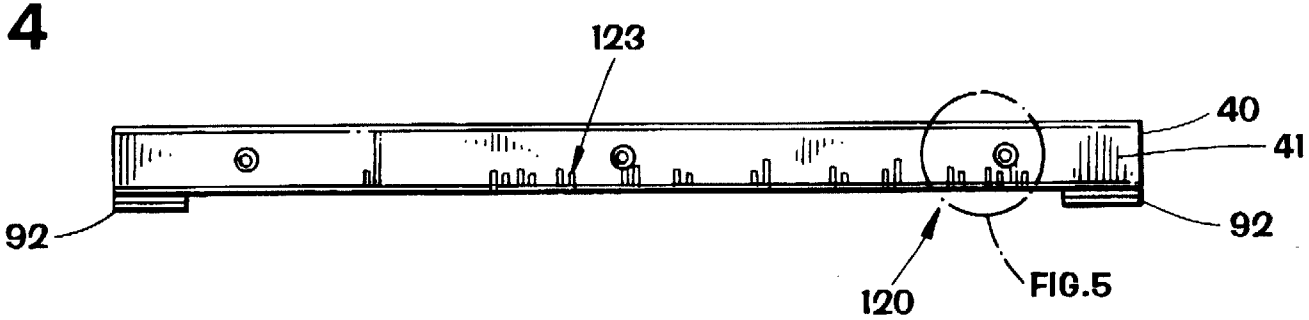
FIG. 4 is a front view of a ribbon bar member in accordance with the present invention.
Figure 5:
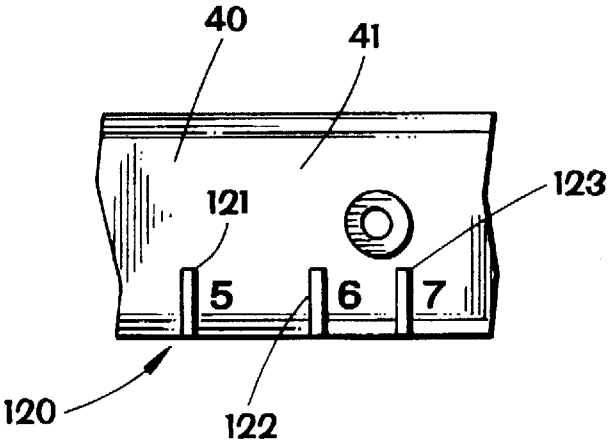
FIG. 5 is an exploded view of the circled portion of FIG. 4.

With reference to FIGS. 4 and 5, ribbon spacing indicia means 120 may be disposed on the front surface 41 of ribbon bar member 40. Ribbon spacing indicia means 120 preferably includes a plurality of embossed "hash marks" 121, 122, 123 formed on the front surface 41 of ribbon bar member 40, and include a number, such as the numbers 5–7, as shown in FIG. 5. Any other method, other than embossing could be used to provide hash marks 121–123. The method of mounting a plurality of military medals 10–13 in accordance with the present invention, including the use of ribbon spacing indicia means 120 will be described in connection with FIGS. 2, and 4–7.

If two medals are to be mounted, a layer of the double-sided tape 101 is disposed upon the front surface 41 of ribbon bar member 40, care being taken not to cover the ribbon spacing indicia means 120. The outer protective, wax paper type layer 102 of the double-sided adhesive tape 101, is removed, and ribbon 14 is abutted against the exposed adhesive tape, with the upper end of ribbon 14 aligned with the lower edge 44 of ribbon bar member 40. The foregoing steps are successively repeated for ribbons 15–17. After ribbons 14–17 have been secured to the front surface 41 of ribbon bar member 40, ribbon bar member 40 is disposed within cavity 58 of ribbon bar clamp member 50 as shown in FIG. 2, whereby a portion 75 of each ribbon 14–17 is disposed between ribbon bar member 40 and ribbon bar clamp member 50, and is also clamped therebetween. Protrusions 81 are engaged in recesses 82, as previously described, as well as foot members 92 are received within recessed slots 91, as previously described. While ribbon bar member 40 is being inserted into ribbon bar clamp member 50, ribbons 14–17 are draped over the smooth, rounded upper edge 45 of ribbon bar member 40 and are suspended over the rear surface 42 of ribbon bar member 40. After ribbon bar member 40 has been received within the cavity 58 of ribbon bar clamp member 50, the protective layer 112 of the ribbon securing means 110, or double-sided adhesive tape 111, is removed from the forward facing surface 52 of front wall 51 of ribbon bar clamp member 50. The ribbons 14–17, with the medals 10–13 suspended therefrom, are then draped over the ribbon bar clamp member into the configuration illustrated in FIGS. 1 and 2, whereby ribbon securing means 110 holds the ribbons 14–17 in place, as illustrated in FIGS. 1 and 2.

Military regulations, such as those of the U.S. Marine Corps for example, permit up to seven full-size military medals being displayed in a manner similar to that illustrated in FIG. 1, wherein the ribbons of the five to seven medals slightly overlap each other, instead of being disposed in an abutting relationship as illustrated in FIG. 1. In order to provide the proper spacing and the proper overlap of adjacent ribbons, it has been found that use of the ribbon spacing indicia means 120 is beneficial. Thus, when the ribbons 14–17, and the for example three additional ribbons (not shown) are secured to the front surface 41 of ribbon bar member 40 in the manner described in connection with FIG. 6, the edges of the ribbons which are to be disposed between ribbons 14 and 17 would have their edges aligned with the appropriate hash mark 121, 122, 123, dependent upon how many ribbons are being mounted. For example, were 7 medals to be mounted, the side edges of the medals and accompanying ribbons to be disposed between ribbons 14–17 would have their side edges aligned with the hash marks 123 on ribbon bar member 40. By correctly aligning the side edges of the various ribbons with the proper hash mark, the necessary and proper overlap of adjacent ribbons will be obtained.

After ribbons 14–17 have been secured to the forward facing surface 52 of front wall 51 of ribbon bar clamp member 50, as previously described, the apparatus 30 of the present invention, including the various ribbons and medals, may then be placed against uniform 20, to secure apparatus 30 to uniform 20, in the manner previously described.

If after two medals have been mounted as illustrated in FIG. 1, the individual receives an additional medal, apparatus 30 may be disassembled and the ribbons may be pulled away from the ribbon securing means 100, 110. The various medals and ribbons may then be adjusted and used again with apparatus 30, in the manner previously described.

It is to be understood that the invention is not limited to the exact details of construction, operation, exact materials, or embodiments shown and described, as obvious modifications and equivalents will be apparent to one skilled in the art. For example, the location and functions of various components may be reversed, such as putting the protrusions 81 on the ribbon bar member, and the recesses 82 on the ribbon bar clamp member 50. Additionally, it should be readily apparent to one of ordinary skill in the art that medals, other than military medals, could be used with the method and apparatus of the present invention, for example, medals awarded to firemen, policemen, and similar types of medals. Accordingly, the invention is therefore to be limited only by the scope of the appended claims.

I claim:

1. An apparatus for mounting a plurality of military medals on a uniform, each medal being suspended from a ribbon, comprising:

an elongate ribbon bar member having a front and a rear surface and an upper edge and a lower edge, the ribbon bar member including a means for securing at least a portion of each ribbon to the front surface of the ribbon bar member;

an elongate ribbon bar clamp member which receives the ribbon bar member and is adapted to clamp a portion of each ribbon between the ribbon bar member and the ribbon bar clamp member; and means for attaching the ribbon bar member and the ribbon bar clamp member to the uniform, whereby the plurality of military medals may be substantially, simultaneously mounted to the uniform.

2. The apparatus of claim 1, wherein the ribbon bar clamp member includes: an elongate front wall, having a forward facing surface and a rearward facing surface and upper and lower ends; an upper flange member associated with the upper end of the front wall; and a lower flange member associated with the lower end of the front wall; the front wall and upper and lower flange members defining a cavity which receives the ribbon bar member, the cavity being adapted to also receive a portion of each ribbon.

3. The apparatus of claim 2, wherein the front wall of the ribbon bar clamp member includes a means for securing at least a portion of each ribbon to the forward facing surface of the front wall after the ribbon bar member has been received within the cavity.

4. The apparatus of claim 2, wherein the ribbon bar member and the ribbon bar clamp member each have a longitudinal axis, the longitudinal axes of the ribbon bar member and the ribbon bar clamp member being disposed substantially parallel with respect to each other, and the ribbon bar clamp member includes a means for preventing relative movement of the ribbon bar member with respect to the ribbon bar clamp member in a direction along the longitudinal axes of the ribbon bar member and the ribbon bar clamp member.

5. The apparatus of claim 4, wherein the means for preventing relative movement includes at least one recessed slot which receives at least one outwardly extending foot member associated with the ribbon bar member.

6. The apparatus of claim 2, wherein the ribbon bar clamp member includes a means for securing the ribbon bar member within the cavity.

7. The apparatus of claim 6, wherein the securing means includes at least one protrusion disposed on the ribbon bar clamp member, which engages with at least one recess in the ribbon bar member to secure the ribbon bar member within the cavity.

8. The apparatus of claim 6, wherein the securing means includes a lip member which extends downwardly from the upper flange member.

9. The apparatus of claim 1, wherein the upper edge of the ribbon bar member a smooth, rounded surface.

10. The apparatus of claim 1, wherein a ribbon spacing indicia means is disposed on the front surface of the ribbon bar member.

11. A method for substantially, simultaneously mounting a plurality of military medals on a uniform, each medal being suspended from a ribbon, comprising the steps of:

providing an elongate ribbon bar member having a front and a rear surface and an upper edge and a lower edge;

providing an elongate ribbon bar clamp member;

securing at least a portion of each ribbon to the front surface of the ribbon bar member;

disposing and clamping a portion of each ribbon between the ribbon bar member and the ribbon bar clamp member; and attaching the ribbon bar member and the ribbon bar clamp member to the uniform, with a portion of each of the ribbons disposed and clamped between the ribbon bar member and the ribbon bar clamp member.

12. The method of claim 11, including the steps of:

providing the ribbon bar clamp member with an elongate front wall having upper and lower ends, an upper flange member associated with the upper end of the front wall, and a lower flange member associated with the lower end of the front wall to define a cavity;

receiving the ribbon bar member within the cavity; and receiving a portion of each ribbon within the cavity.

13. The method of claim 12, including the step of securing the ribbon bar member within the cavity, by snap fitting the ribbon bar member within the cavity.

14. The method of claim 12, including the steps of:

providing the ribbon bar clamp member with a front wall with a forward facing surface; and providing a means for securing at least a portion of each ribbon to the forward facing surface of the front wall after the ribbon bar member has been received within the cavity.

15. The method of claim 11, including the step of preventing relative movement of the ribbon bar member with respect to the ribbon bar clamp member in a direction along the longitudinal axes of the ribbon bar member and the ribbon bar clamp member.

16. The method of claim 11, including the step of providing the upper edge of the ribbon bar member with a smooth, rounded surface.

17. The method of claim 11, including the step of:

providing the front surface of the ribbon bar member with a ribbon spacing indicia means; and utilizing the ribbon spacing indicia means to evenly space a portion of each ribbon from, and with respect to, portions of adjacent ribbons.

18. The method of claim 11, including the step of substantially, simultaneously mounting at least two military medals.

* * * * *